United States Patent [19]

St-Onge, Georgette G.

[11] 4,003,108

[45] Jan. 18, 1977

[54] SLIDER FOR SLIDE FASTENERS

[76] Inventor: St-Onge, Georgette G., 325 Sauve St., W., Apt. 5, Montreal, Quebec, Canada, H3L 1Z6

[22] Filed: Aug. 11, 1975

[21] Appl. No.: 603,273

[52] U.S. Cl. ..... 24/205.15 E; 24/252 R

[51] Int. Cl.[2] ..... A44B 19/28

[58] Field of Search ..... 24/205.15 E, 252 R; 29/207.5 SL, 243.5; 81/427

[56] References Cited

UNITED STATES PATENTS

| | | | |
|---|---|---|---|
| 1,116,249 | 11/1914 | Meier | 24/205.15 E |
| 2,366,797 | 1/1945 | Legat | 24/205.15 E |
| 2,799,909 | 7/1957 | Dellaquila | 24/205.15 E |
| 3,456,262 | 7/1969 | Coon | 24/137 A |
| 3,808,665 | 5/1974 | Bannies | 24/205.15 E |

FOREIGN PATENTS OR APPLICATIONS

| | | | |
|---|---|---|---|
| 885,456 | 9/1943 | France | 24/205.15 E |
| 179,385 | 5/1962 | Sweden | 24/252 |

*Primary Examiner*—Bernard A. Gelak
*Attorney, Agent, or Firm*—Roland L. Morneau

[57] ABSTRACT

A slider for slide fasteners of the type having interlocking elements attached to opposed stringers comprises upper and lower members pivotally mounted with respect to each other about a pivot axis. Each member has a forward jaw portion adapted to engage the interlocking elements, and a handle portion having an aperture therein and extending beyond the pivot axis. A V-shaped spring has its legs threaded through the apertures and the free end of the legs are in contact with the jaw portions for biasing them together, whereby a pressure exerted on the handle portions will cause opening of the jaw portions and permit disengagement of the slider from the interlocking elements.

1 Claim, 3 Drawing Figures

SLIDER FOR SLIDE FASTENERS

This invention relates to a slider for slide fasteners, and more particularly to a slider which may be easily disengaged from and mounted on the slide fastener stringers.

It is known to provide sliders with separable guide plates which may be disassembled for the purpose of freeing the plates when they become jammed or damaged. One example of such sliders is the one disclosed in U.S. Pat. No. 2,608,734 issued Sept. 2nd, 1952. However, the sliders of that type are generally complicated and expensive.

It is the object of the present invention to provide a slider which may be easily installed on the slide fastener stringers or removed therefrom.

More particularly, it is the object of the present invention to provide a slider which may be carried along as a safety device in case of breakage or jamming of the regular sliders installed on garments, camping tents, or other pieces of sport equipment.

The slider, in accordance with the invention, comprises upper and lower members pivotally mounted with respect to each other about a pivot point. Each member has a forward jaw portion adapted to engage the interlocking elements attached to the stringers and a handle portion extending rearwardly from such pivot point. The jaw portions of the slider are biased together by means of a spring and may be separated by squeezing the handle portions thereof, thereby pivoting the upper and lower members around their pivot point.

Each jaw comprises a guide plate provided with slide flanges adapted to cause engagement of the interlocking elements in one direction of movement of the slider, and a wedge shaped member adapted to disengage the interlocking elements in the other direction of movement of the slider.

Each handle portion of the slider may be provided with an aperture and the spring means may be V-shaped having the legs thereof passing through such apertures and its open portion contacting the jaws so as to hold the two members together and, at the same time, bias the jaws into engagement.

The invention will now be disclosed by way of example, with reference to an embodiment thereof illustrated in the accompanying drawings in which.

Figure 1:
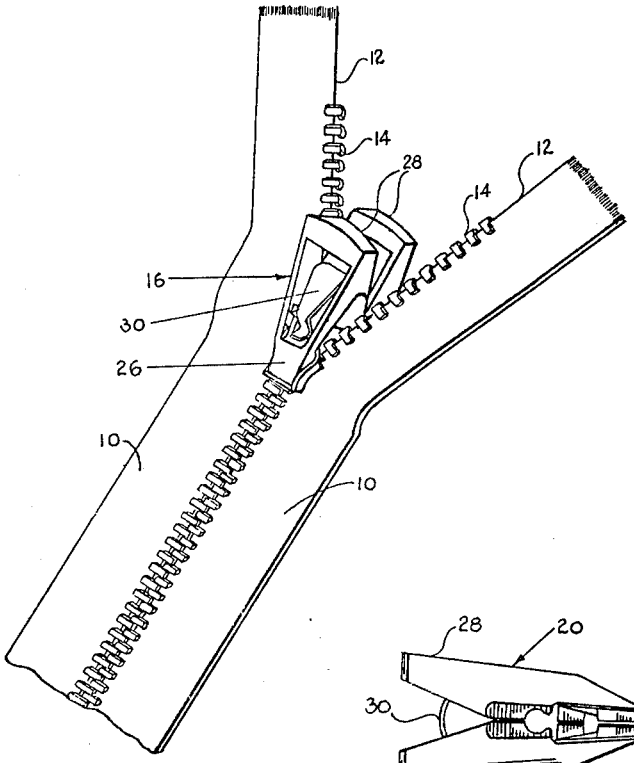
FIG. 1 is a perspective view, on an enlarged scale, of a slide fastener embodying a slider in accordance with the invention.

Referring to FIG. 1, there is shown a slide fastener comprising a pair of stringers 10 which are provided along their opposed edges with the usual beaded edges 12 upon which are mounted a plurality of interlocking elements 14. These are of the conventional type and comprise heads having interlocking means such as projections on the upper sides and recesses on the lower sides. The interlocking elements 14 are engaged by means of the slider identified generally by reference numeral 16.

Figure 2:
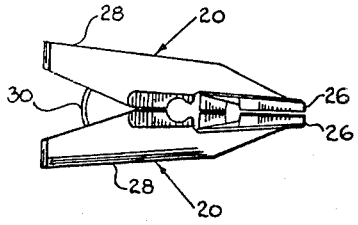
FIG. 2 is a side view of the slider illustrated in FIG. 1.
Figure 3:
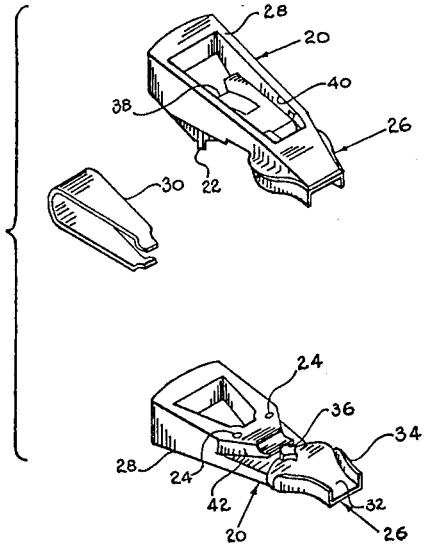
FIG. 3 is an exploded view, in perspective, showing the component parts of the slider in accordance with the invention.

Referring now to FIGS. 2 and 3, the slider 16 comprises, generally, upper and lower members 20 pivotally mounted with respect to each other about a pivot point formed by projections 22 and recesses 24. Each member 20 has a forward jaw portion 26 secured thereto or formed integrally therewith and a handle portion 28. A spring 30 is provided for holding the two members 20 together and, at the same time, bias the jaws 26 into contact with the interlocking elements 14 as illustrated in FIG. 1. Each jaw comprises, in conventional manner, a guide plate 32 provided with side flanges 34 adapted to cause engagement of the interlocking elements in one direction of movement of the slider, and a wedge shaped member 36 adapted to disengage the interlocking elements in the other direction of movement of the slider.

The handles 28 are provided with an aperture 38 and the legs of spring 30 are threaded through such aperture and adapted to contact the surfaces 40 of the jaws to hold the two members 20 together. The open portion of the V-shaped spring 30 contacts the jaws 26 to bias them into engagement.

The two sides 42, one of which is illustrated in FIG. 3 are preferably separated by a relatively small angle that is $25° \pm 5°$. A small angle is preferred because the installation and the removal of the slider is easier. This is particularly due to the fact that this slider is adapted to be used as a substitute when the original one is stucked or out of service.

The slider according to the invention may be made of metal or plastic. The choice may vary according to the material of the interlocking elements 14, the size of the zipper, the maintenance desired, etc. The spring 30 must have a sufficiently strong resilience so as to maintain the two parts 20 firmly together and also adapted to be repeatedly bent.

The operation of the slider, in accordance with the invention is as follows:

When it is desired to use the slider, the handle portions 28 are squeezed together forcing the members 20 to pivot around points 22, 24 and thus open the jaw portions 26. The latter may then be positioned so as to properly engage the interlocking elements. The slider may be removed from the stringers 10 by following the same procedure.

Although the invention has been disclosed, by way of example, with reference to a preferred embodiment thereof, it is to be understood that various modifications may be made to such embodiment without departing from the spirit of the invention. For example, the jaw portions 26 may be made integrally with the handle portions 28. In addition, the spring 30 may take various shapes and the members 20 may be pivotally connected to each other in various ways.

It should be obvious that an arrangement may be foreseen for retaining together the two members in a pivoting engagement while the spring would tend to push apart the two handles and consequently to resiliently push the jaws together.

What I claim is:

1. A slider for slide fasteners of the type having interlocking elements attached to opposed stringers comprising:

a. an upper and lower member superposed over each other, each member having, at one end, a jaw portion for slidingly receiving the interlocking elements of a slide fastener, and, at the other end, a handle portion, both said portions being separated by a transverse pivot axis pivoted on and across the side of the members facing each other for allowing a rocking action of one member over the other, the handle portions being provided with an aperture, each aperture facing each other, b. a spring for maintaining said members into a superposed position and for resiliently urging the jaw portions towards each other and in a position for overlapping the said interlocking elements, the facing sides of said members corresponding to said handle portions tapering away from the said pivot axis so that when the handle portions are manually urged together, the jaw portions spread apart to release the interlocking elements, the said spring being V-shaped, the apex of said spring being aligned with the said apertures and both legs of said spring extending over both jaw portions, the free end of said legs grippingly engaging said jaw portions to urge the latter together, each jaw portion comprises a guide plate provided with side flanges adapted to cause engagement of the interlocking elements when the slider is moved in the direction of the handle, and a wedge shaped member secured to the rear of the said guide plates facing each other and along the median line passing therethrough, the said wedge shaped member adapted to disengage the interlocking elements when the slider is moved in the direction of the jaw portions, the said upper and lower members being provided, on their side facing each other, with two spaced lateral walls rearwardly of said wedge shaped members, wherein the paths defined by the guide plates, the side flanges, the wedge shaped members and the said lateral walls have an angle of about 25° ± 5°, whereby a constant manual pressure exerted on said handle portions towards one another will cause a continuous and progressive opening of said jaw portions and permit disengagement of the slider from the interlocking elements.

* * * * *